United States Patent [19]

Audeh et al.

[11] Patent Number: 4,466,882

[45] Date of Patent: Aug. 21, 1984

[54] SIMULTANEOUS BENEFICIATION AND TREATMENT OF OIL SHALE

[75] Inventors: Costandi A. Audeh, Princeton, N.J.; Joseph J. Dickert, Jr., Yardley; Patrick E. Fowles, Doylestown, both of Pa.

[73] Assignee: Mobil Oil Corporation, New York, N.Y.

[21] Appl. No.: 490,903

[22] Filed: May 2, 1983

[51] Int. Cl.[3] ..... C10G 1/00; C10B 53/06

[52] U.S. Cl. ..... 208/11 R; 208/11 LE

[58] Field of Search ..... 208/8 R, 11 R, 11 LE, 208/196; 75/2

[56] References Cited

U.S. PATENT DOCUMENTS

| | | | |
|---|---|---|---|
| 2,609,331 | 9/1952 | Cheney | 202/11 |
| 3,656,938 | 4/1972 | Penzes | 75/2 X |
| 3,816,301 | 6/1974 | Sorgenti | 208/196 X |
| 4,108,760 | 8/1978 | Williams et al. | 208/11 R X |
| 4,176,042 | 11/1979 | Fahlström | 208/11 LE |
| 4,177,064 | 12/1979 | Wanzenburg et al. | 208/11 R X |
| 4,214,046 | 7/1980 | Waltrip | 208/8 R X |
| 4,239,613 | 12/1980 | Schulz | 208/8 R X |
| 4,260,471 | 4/1981 | Miller | 208/8 R X |
| 4,269,702 | 6/1981 | Milner et al. | 75/2 X |
| 4,348,274 | 9/1982 | Guerre | 208/11 R X |

*Primary Examiner*—Delbert E. Gantz
*Assistant Examiner*—Glenn A. Caldarola
*Attorney, Agent, or Firm*—Alexander J. McKillop; Michael G. Gilman; Charles J. Speciale

[57] ABSTRACT

The present invention relates to a beneficiation process for oil shale ore which contains substantial or detrimental amounts of pyrites wherein the ore is simultaneously treated to substantially reduce hydrogen sulfide formation during subsequent retorting.

14 Claims, No Drawings

SIMULTANEOUS BENEFICIATION AND TREATMENT OF OIL SHALE

FIELD OF THE INVENTION

The present invention relates to a process for the simultaneous beneficiation and treatment of oil shale. More specifically, the present invention relates to a process for the simultaneous beneficiation and treatment of oil shale to improve the oil shale grade and to reduce hydrogen sulfide formation during retorting.

BACKGROUND OF THE INVENTION

Large deposits of oil shale are found in many locations throughout the world, and extensive efforts have been undertaken to develop oil shale as a source of hydrocarbon products. In fact, the potential reserves of liquid hydrocarbons to be derived from oil shale greatly exceed the known reserves of liquid hydrocarbons to be derived from petroleum. It has long been known that oil may be extracted by heat from various extensive deposits of porous minerals known by their generic term "oil shale", which are permeated by a complex organic material called "kerogen". Upon application of heat, the kerogen is converted to a complex mixture of hydrocarbons and hydrocarbon derivatives which may be recovered from a retort as a liquid shale oil product.

However, many oil shales, particularly the Devonian black shales of the eastern United States, contain large amounts of iron pyrites ($FeS_2$). For example, a New Albany, Bullett County, oil shale contains about 6 percent pyritic sulfur and 12 percent organic carbon. This pyrite is the cause of at least two serious problems in the winning of oil from the shales. At retorting temperatures, the iron pyrite reacts with the organic matter, generated from kerogen, robbing it of hydrogen, thus resulting in a poorer product and/or a lower yield of oils. Additionally, as a consequence of the foregoing reaction, large quantities of hydrogen sulfide are formed. Because of environmental considerations and due to its corrosive characteristics, the hydrogen sulfide has to be removed, for example, by converting it to sulfur.

Additionally, because of the high temperatures required in known retorts and retorting processes for obtaining hydrocarbon values from oil shale, and the resultant need for large amounts of energy to provide such heat, it is desirable to retort as little oil shale as possible to obtain each gallon of oil.

Thus, it would be advantageous to have a process wherein the oil shale ore is upgraded and wherein at the same time the oil shale is treated to substantially reduce the amount of hydrogen sulfide formed during subsequent retorting.

SUMMARY OF THE INVENTION

In accordance with the present invention, a beneficiation process has been developed for upgrading oil shale ore while at the same time the oil shale ore is treated to substantially reduce the amount of hydrogen sulfide formed during subsequent retorting of the shale. Thus, the present invention comprises the steps of beneficiating the oil shale with an aqueous medium wherein the aqueous medium contains mild oxidants sufficient to oxidize the pyrites present in the oil shale. The resultant ore is subjected to retorting to recover therefrom hydrocarbon fluids, gases or mixtures thereof.

In accordance with one aspect of the invention, a process is provided for beneficiating the oil shale ore and for substantially reducing hydrogen sulfide formation during subsequent retorting wherein the oil shale is beneficiated utilizing an aqueous solution of hydrogen peroxide. Heat may be applied to enhance the rate of mild oxidation of the shale, however, care should be taken to prevent the oxidation of any substantial amounts of kerogen. The resultant oil shale from beneficiation is retorted to recover therefrom hydrocarbon fluids, gases or mixtures thereof.

DESCRIPTION OF SPECIFIC EMBODIMENTS

In accordance with the present invention, oil shale which contains substantial or detrimental amounts of pyrites, is simultaneously beneficiated and treated under mild oxidative conditions for a sufficient time to result in a substantial increase in the amount of oil produced per amount of shale, and a substantial reduction in the amount of hydrogen sulfide produced during subsequent retorting. The oil shale may be crushed to a desirable size prior to beneficiation and mild oxidation. However, some oil shales, such as Eastern shales, fracture when placed in an aqueous medium and accordingly such shale do not need to be crushed prior to beneficiation and oxidation.

It is known that the kerogen content of oil shale increases as the oil shale gravity decreases. This is due to the difference in kerogen specific gravity, for example about 1.05, and average mineral specific gravity, for example about 2.7. In accordance with the present invention, oil shale, of desirable size, is placed in an aqueous medium. A gas such as air is bubbled through the aqueous medium to separate the lighter shale from the heavier mineral material by floatation. The gas utilized may be oxygen or an oxygen-containing gas thus oxidizing the shale, particularly, the pyrites in the shale. On the other hand, the aqueous medium may contain a mild oxidant such as hydrogen peroxide. The combination of type of gas and oxidants in the aqueous medium should be such that mild oxidation of the shale takes place. The conditions of oxidation should be such that oxidation of the pyrites in the shale takes place without substantial oxidation of the kerogen. Other additives may be added to the aqueous medium to adjust its density to assist in the separation of the shale. Density of the aqueous medium can be custom designed to fit the process requirements.

A Beneficiation process which may be utilized in accordance with the present invention is what is known in the art as the "Heavy Medium Density Separation" hereinafter referred to as HMD separation. In the HMD separation process, shale having a maximum size of about 130 mm is dry screened to remove all materials less than 6 mm. The 130 to 6 mm fraction is fed to a heavy media vessel operating at 2.3 to 2.4 specific gravity wherein the fluid medium additionally contains a mild oxidant. The lean shale pieces sink and the high kerogen shale pieces float. The float material is recovered and may be subjected to a second HMD separation vessel operated at a specific gravity range of 1.9 to 2.2 or the float material may be subjected to retorting. Several stages of HMD separations may be applied depending on the desired number of fractions and the desired end product.

Whichever process is utilized for the simultaneous beneficiation and oxidation of the oil shale, retorting the resultant shale leads to a substantial increase in the amount of oil produced per amount of shale treated while at the same time resulting in a substantial decrease in the amount of hydrogen sulfide formed.

During beneficiation and oxidation heat may be applied to increase the rate of oxidation. When hydrogen peroxide is utilized as the oxidant during beneficiation, it is preferred that low concentrations be utilized, i.e. 1 to 10% hydrogen peroxide solutions. However, higher concentrations can be utilized when the addition or contact conditions are adjusted to achieve mild oxidation. For instance, a 30% hydrogen peroxide solution may be utilized when such is added dropwise to the beneficiation fluids. It is well within the knowledge of those skilled in the art to control the conditions to achieve mild oxidation. Care should be taken to prevent overoxidation or severe oxidation because such would result in the oxidation of the kerogen in the shale.

To better illustrate the oxidation aspect of the invention a number of experiments were run. About 200 grams of an eastern U.S. oil shale placed in one liter of water, were treated dropwise with 500 mls of a 30 percent hydrogen peroxide solution. The mixture was cooled to room temperature and allowed to settle. The clear liquid was decanted and the mixture was washed with water until the wash water showed the absence of sulfate as indicated by the addition of barium. The wet reaction mixture was filtered and dried in a vacuum at about 130° C. The dry solid was then pelleted and crushed to 16/35 mesh, the standard mesh size used for retorting studies.

Two retorting procedures were followed to assess the degree to which the production of hydrogen sulfide was reduced. In the first procedure, Fischer Assay ASTM D3904 retorting was followed. This is a standard ASTM method and requires the use of a specific retorting vessel, a Fischer retort, and a specific heat-up rate of 12° C./min., from ambient temperatures to 500° C. Also, the method specifies maintaining the shale at 500° C. for 40 minutes, plus or minus 5 minutes.

In the second retorting procedure, rapid heat-up Assay (annular retort) procedure was followed. An apparatus, the annular retort, was specially designed and built to achieve a rapid rise in temperature, from ambient to about 400° C. The ambient retort is a vessel constructed of two concentric stainless steel tubes with a quarter of an inch annulus. The design allows for a quarter inch thick bed of shale to be packed into the annulus and for heating the shale from the inside and the outside of the annulus when placed in a fluidized sand bath. Retorting in the annular retort followed the standard Fischer Assay ASTM D3904 procedure except that the heat-up rate was 380° C. per minute.

In Example 1 a 100 gram sample of untreated shale, crushed to 16/35 mesh, was retorted according to the Fischer Assay ASTM D3904. In Example 2, a 100 gram sample of treated shale, 16/35 mesh, was retorted as described in Example 1. In Example 3 a 100 gram sample of untreated shale, 16/35 mesh, was retorted in the annular retort using the rapid heat-up Assay procedure. Example 4 relates to the retorting of a 100 gram sample of treated shale, 16/35 mesh, as described in Example 3. The oil, water and hydrogen sulfide yields for Examples 1, 2, 3 and 4 are shown in Table I.

TABLE I

| | Fischer Assay Shale Used | | Rapid Heat-Up Assay Shale Used | |
|---|---|---|---|---|
| Example # | Untreated 1 | Treated 2 | Untreated 3 | Treated 4 |
| Yield: | | | | |
| Oil, % Wt. | 4.7 | 5.4 | 5.6 | 6.2 |
| Gal/ton | 11.8 | 13.0 | 14.6 | 16.0 |
| Water, % Wt. | 1.3 | 1.2 | 1.3 | 2.0 |
| Hydrogen sulfide, % Wt. | 1.2 | 0.1 | 1.4 | 0.2 |

Upon retorting, the peroxide treated shale yields the same amount of oil as the untreated shale, however, the amount of hydrogen sulfide is reduced. As shown in Table I the untreated shale produced 1.2% by weight hydrogen sulfide under Fischer Assay conditions and 1.4% in the rapid heat-up Assay, but the treated shale produced only 0.1% and 0.2% hydrogen sulfide, respectively. This represents a 90% reduction in the hydrogen sulfide produced. Analysis of the oil shale before and after the treatment with the hydrogen peroxide solution under mild oxidative conditions shows that the total sulfur content of the shale was reduced by about 12 percent while in subsequent retorting a 90 percent reduction in hydrogen sulfide formation was observed. It is concluded that the mild oxidative treatment passivates the pyrites in the oil shale in such a manner as to reduce its reactivity during the retorting process.

It is important to note that the oxidation of the shale should be conducted under mild oxidative conditions so as to prevent any substantial oxidation of the kerogen in the oil shale. To demonstrate such, the following example was run. Oil shale was packed in a retort and a mixture of air and steam was passed through the shale. About 30 liters of air were used for the oxidation. That oxidation took place was confirmed by the analysis of the gas leaving the retort. A reduction is oxygen to about 8% was observed. At the conditions of the oxidation chosen, 175° C. and 375 psig, a significant amount of the kerogen was oxidized. This conclusion was based on the results of the retorting step shown in Table II. Retorting produced only 50% as much oil from the air-steam treated sample, as from the untreated oil shale. Hydrogen sulfide formation was also reduced by 50%. The above data seems to clearly indicate that milder oxidation conditions are desirable to achieve the desired pyrite passivation without kerogen oxidation.

TABLE II

| | Untreated Shale | Air/steam Treated Shale |
|---|---|---|
| Yield: | | |
| Oil: wt. % | 4.7 | 2.3 |
| Gal./ton | 11.8 | 5.5 |
| Water: wt. % | 1.3 | 2.4 |
| $H_2S$: wt. % | 1.2 | 0.5 |

As can be seen from the above, subjecting the oil shale to mild oxidation results in substantially reducing the amount of hydrogen sulfide produced during retorting. Additionally, beneficiation results in improving the grade of the oil shale, i.e. the amount of oil produced per amount of shale treated. The present invention lies in combining the above two processes resulting in a process for the simultaneous beneficiation of oil shale and treatment of oil shale to upgrade the quality of the shale and to reduce the amount of hydrogen sulfide produced during subsequent retorting. This is achieved by carrying out the beneficiation step under mild oxidative conditions.

Although the present invention has been described with preferred embodiments, it is to be understood that modifications and variations may be resorted to as those skilled in the art will readily understand. Such modifications and variations are considered to be within the purview and scope of the appended claims.

What is claimed is:

1. A beneficiation process for oil shale ore which additionally contains pyrites wherein the ore is simultaneously treated to substantially reduce hydrogen sulfide formation during subsequent retorting, comprising the steps of:

(a) subjecting the oil shale ore to an aqueous medium which additionally contains hydrogen peroxide as a mild oxidant;

(b) bubbling gas through the aqueous medium to agitate the oil shale ore, separate higher grade shale ore by flotation, and oxidize at least part of the pyrites present in the oil shale ore; and (c) collecting the floated oil shale ore and retorting to produce hydrocarbon fluids, gases, or mixtures thereof wherein the hydrocarbon sulfide formation is substantially less than that compared to directly retorting said oil shale ore.

2. The process of claim 1 wherein the hydrogen peroxide concentration is from about 1 to about 30 volume percent.

3. The process of claim 1 wherein the gas utilized comprises oxygen, air, an oxygen-containing gas or any combination thereof.

4. The process of claim 1 wherein heat is applied to the aqueous medium to enhance the oxidation rate.

5. The process of claim 1 wherein the aqueous medium is treated to adjust its density to enhance the separation of higher grade oil shale ore.

6. The process of claim 1 wherein the hydrogen peroxide concentration is from about 1 to 10 volume percent.

7. A beneficiation process for oil shale ore which additionally contains pyrites wherein the ore is simultaneously treated to substantially reduce hydrogen sulfide formation during subsequent retorting, comprising the steps of:

(a) subjecting the oil shale ore to an aqueous medium;

(b) bubbling oxygen, an oxygen-containing gas or any combination thereof through the aqueous medium to agitate the oil shale ore, separate higher grade shale ore by floatation, and oxidize at least part of the pyrites present in the oil shale ore; and (c) collecting the floated oil shale ore and retorting to produce hydrocarbon fluids, gases, or mixtures thereof wherein the hydrogen sulfide formation is substantially less than that compared to directly retorting said oil shale ore.

8. The process of claim 7 wherein the aqueous medium addition contains from about 1 to about 30 volume percent hydrogen peroxide.

9. The process of claim 7 wherein heat is applied to the aqueous medium to enhance the oxidation rate.

10. The process of claim 7 wherein the aqueous medium is treated to adjust its density to enhance the separation of higher grade oil shale ore.

11. The process of claim 7 wherein the aqueous medium additionally contains from about 1 to 10 volume percent hydrogen peroxide.

12. A beneficiation process for oil shale ore which additionally contains pyrites wherein the ore is simultaneously treated to substantially reduce hydrogen sulfide formation during subsequent retorting, comprising the steps of:

(a) crushing the shale ore to a maximum size of about 130 mm;

(b) feeding the crushed ore to a heavy media vessel, wherein the heavy media additionally contains hydrogen peroxide as a mild oxidant, to separate higher grade shale ore by flotation and oxidize at least part of the pyrites present in the oil shale ore;

(c) collecting the floated oil shale ore and preparing for retorting; and (d) retorting the oil shale ore to produce hydrocarbon fluids, gases or mixtures thereof wherein the hydrogen sulfide formation is substantially less than that compared to directly retorting said oil shale ore.

13. The process of claim 12 wherein the heavy media vessel is operated at a specific gravity of from about 1.9 to about 2.4.

14. The process of claim 12 wherein the oxidant comprises hydrogen peroxide in a concentration of from about 1 to about 10 volume percent.

* * * * *

UNITED STATES PATENT AND TRADEMARK OFFICE

CERTIFICATE OF CORRECTION

PATENT NO. : 4,466,882

DATED : August 21, 1984

INVENTOR(S) : C.A. Audeh, J.J. Dickert, Jr. and P.E. Fowles

It is certified that error appears in the above-identified patent and that said Letters Patent is hereby corrected as shown below:

Column 4, line 38 - "is" should be --in--.

Column 6, line 12 - "addition" should be --additionally--.

Signed and Sealed this

*Nineteenth* Day of *March 1985*

[SEAL]

*Attest:*

DONALD J. QUIGG

*Attesting Officer* *Acting Commissioner of Patents and Trademarks*